United States Patent [19]

Iwata et al.

[11] Patent Number: 4,979,485

[45] Date of Patent: Dec. 25, 1990

[54] CYLINDER RECOGNITION APPARATUS FOR AN INTERNAL COMBUSTION ENGINE

[75] Inventors: Toshio Iwata; Wataru Fukui, both of Himeji, Japan

[73] Assignee: Mitsubishi Denki Kabushiki Kaisha, Tokyo, Japan

[21] Appl. No.: 416,303

[22] Filed: Oct. 3, 1989

[30] Foreign Application Priority Data

| | | | |
|---|---|---|---|
| Oct. 5, 1988 | [JP] | Japan | 63-249960 |
| Oct. 6, 1988 | [JP] | Japan | 63-250908 |
| Oct. 6, 1988 | [JP] | Japan | 63-250911 |
| Oct. 12, 1988 | [JP] | Japan | 63-254765 |

[51] Int. Cl.[5] ..... F02P 9/00

[52] U.S. Cl. ..... 123/613; 123/643

[58] Field of Search ..... 123/613, 612, 643, 414, 123/416, 417, 418; 364/431.03

[56] References Cited

U.S. PATENT DOCUMENTS

| | | | |
|---|---|---|---|
| Re. 31,709 | 10/1984 | Ford | 123/416 |
| 3,613,654 | 10/1971 | Gilbert | 123/613 |
| 3,621,826 | 11/1971 | Chrestensen | 123/613 |
| 4,122,814 | 10/1978 | Ford | 123/613 |
| 4,700,305 | 2/1987 | Lotterbache et al. | 364/431.03 |
| 4,856,489 | 8/1989 | Ozawa | 123/643 |

*Primary Examiner*—Raymond A. Nelli

*Attorney, Agent, or Firm*—Sughrue, Mion, Zinn, Macpeak & Seas

[57] ABSTRACT

A cylinder recognition apparatus for a multi-cylinder internal combustion engine has a position sensor which generates for each cylinder output pulses which indicate prescribed positions of the piston of the cylinder. The output pulse for a prescribed reference cylinder of the engine has a different pulse width from the pulses for the other cylinders. A cylinder recognition circuit calculates a ratio which is a function of the pulse width and the period of each output pulse. A comparator compares the ratio with a prescribed value and a cylinder is recognized on the basis of the comparison.

20 Claims, 6 Drawing Sheets

CYLINDER RECOGNITION APPARATUS FOR AN INTERNAL COMBUSTION ENGINE

BACKGROUND OF THE INVENTION

This invention relates to a cylinder recognition apparatus which can recognize a prescribed reference cylinder of an internal combustion engine as well as generate control signals for controlling the ignition timing of the engine.

In order for an internal combustion engine to operate optimally, fuel injection and ignition must take place at prescribed rotational angles of the crankshaft of the engine, i.e., when each piston of the engine is at a prescribed position with respect to top dead center. For this reason, an engine is equipped with a rotational position sensor which senses the rotational angle of the crankshaft of the engine. One common type of position sensor is in the form of a rotating plate mounted on a rotating shaft (such as the distributor shaft) which rotates in synchrony with the crankshaft of the engine. The rotating plate has a set of slits formed in it at prescribed locations. A light emitting diode is disposed on one side of the rotating plate, and a light sensor is disposed on the other side of the rotating plate in alignment with the light emitting diode. The light sensor generates an output signal each time one of the slits passes between the light sensor and the light emitting diode. The slits, which are equal in number to the cylinders, are disposed so as to correspond to prescribed rotational angles of the crankshaft and thus to prescribed positions of each piston with respect to top dead center.

In addition to knowing when the crankshaft reaches a prescribed rotational position for each cylinder, in engines in which the cylinders are individually controlled, it is necessary to be able to identify each cylinder. Engines which perform individual control of the cylinders are therefore equipped with a second position sensor for sensing when the crankshaft rotational angle is such that the piston of a specific reference cylinder is in a prescribed position. The second position sensor frequently comprises an additional slit which is formed in the above-described rotating plate, an additional light emitting diode, and an additional light sensor which detects the passage of light through the additional slit as the rotating plate is rotated. By using the outputs of the two position sensors in conjunction, it can be determined which cylinder of the engine is firing at any given time.

Thus, a conventional engine is frequently equipped with two position sensors, each including a light emitting diode and a light sensor. However, as position sensors are expensive and each one requires a separate interface circuit for connection to an engine controller, the use of two separate position sensors is uneconomical. It is also disadvantageous from the standpoint of space utilization in an engine.

SUMMARY OF THE INVENTION

Accordingly, it is an object of the present invention to provide a cylinder recognition apparatus for an internal combustion engine which can detect a prescribed rotational position of the crankshaft for each cylinder of the engine as well as recognize a prescribed cylinder using only a single position sensor.

It is another object of the present invention to provide a cylinder recognition apparatus which can operate accurately when the engine rotational speed is in transition.

It is yet another object of the present invention to provide a cylinder recognition apparatus which is compact and economical to manufacture.

A cylinder recognition apparatus according to the present invention is equipped with a single position sensor which generates a series of signals. Each signal corresponds to one cylinder and indicates a first position and a second position with respect to top dead center of the piston of the cylinder. The number of degrees of crankshaft rotation between the first and second piston positions is different for a prescribed reference cylinder of the engine than for the other cylinders of the engine. Based on the output signals of the position sensor, a first period sensor measures a first period T between consecutive first piston positions or between consecutive second piston positions. A second period sensor measures a second period t between consecutive first and second piston positions. A ratio calculating circuit calculates a ratio which is a function of the first and second periods T and t, and a comparator compares the ratio with a prescribed value. The prescribed value is chosen so that the result of comparison will be different for a ratio corresponding to the reference cylinder and a ratio corresponding to one of the other cylinders. On the basis of the comparison, the reference cylinder is recognized.

In preferred embodiments, the signal from the position sensor is in the form of pulses. The above-described first period is the period T of the pulses, and the above-described second period is the pulse width t of the pulses. In preferred embodiments, the ratio which is used for comparison is expressed as either $t/T$ or as $t/(T-t)$.

The prescribed value which is compared with the above-described ratio can have various values. In one preferred embodiment, the prescribed value is the average of the ratios for two consecutive output pulses of the position sensor. In another preferred embodiment, the prescribed value is the ratio for the preceding output pulse of the position sensor. In still another preferred embodiment, the prescribed value is an average of the ratios for all the output pulses during a single cycle of the engine.

In preferred embodiments, the position sensor comprises a rotating plate having a plurality of slits of varying length formed in it, a light source, and a light sensor which detects the passage through the slits of light from the light source. However, the position sensor is not restricted to any particular type, as long as it can generate signals indicating first and second positions of the pistons of the engine, with the number of degrees of crankshaft rotation between the first and second positions being different for a reference cylinder than for the other cylinders of the engine. For example, the position sensor could be in the form of a plurality of projections formed on a rotating shaft and a transducer which interacts magnetically or optically with the projections as they pass by the transducer.

DESCRIPTION OF THE PREFERRED EMBODIMENTS

Figure 1:
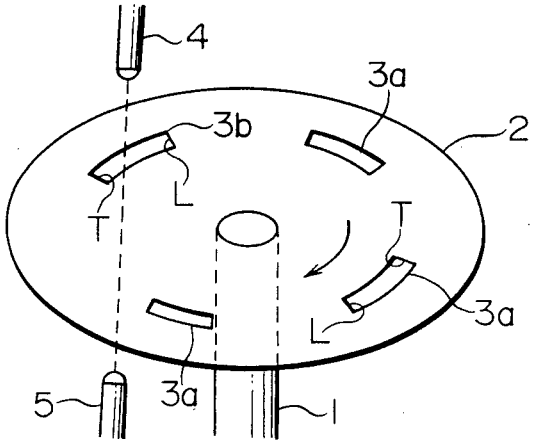
FIG. 1 is a schematic perspective view of a portion of a rotational position sensor for a cylinder recognition apparatus according to the present invention.

A number of preferred embodiments of a cylinder recognition apparatus according to the present invention will now be described while referring to the accompanying drawings. FIG. 1 is a schematic perspective view of a portion of a rotational position sensor which is employed in the present invention for sensing the rotational position of an engine crankshaft. As shown in this figure, a rotating shaft 1 is rotated in synchrony with an unillustrated four-cylinder engine. The rotating shaft 1 can be, for example, the shaft of a distributor which is rotated by the cam shaft of the engine in the direction indicated by the arrow. A rotating disk 2 having a plurality of slits 3*a* and 3*b* formed in it is secured to the shaft 1 at the center of the disk 2. Each of the slits 3*a* or 3*b* corresponds to one of the cylinders of the engine, so for a four-cylinder engine, there are four slits in the disk 2. The slits 3*a* and 3*b* are equally distant from the center of the rotating disk 2. Three of the slits 3*a* have the same length as one another in the circumferential direction of the disk 2, while the fourth slit 3*b* has a different length from the other slits 3*a*. The fourth slit 3*b* functions as a reference slit and corresponds to a reference cylinder of the engine, which in the present embodiment is cylinder #1, although any of the other cylinders could instead be employed as a reference. The fourth slit 3*b* is illustrated as being longer in the circumferential direction than the other slits 3*a*, but it could instead be made shorter than the others. Each of the slits 3*a* and 3*b* has a leading edge L and a trailing edge T. The leading edges L of all four slits 3*a* and 3*b* are equally spaced around the disk 2 at intervals of 90 degrees. However, since the fourth slit 3*b* is longer than the other slits 3*a*, its trailing edge T is offset by a prescribed angle (10 degrees, for example, measured from the center of the disk 2) with respect to the trailing edges T of the other slits 3*a*.

A light source in the form of a light emitting diode 4 and a light sensor in the form of a phototransistor 5 are aligned with one another on opposite sides of the rotating disk 2. When one of the slits 3*a* or 3*b* is aligned with the light emitting diode 4 and the phototransistor 5, light from the light emitting diode 4 can reach the phototransistor 5, which turns on. At other times, the phototransistor 5 remains off.

Figure 2:
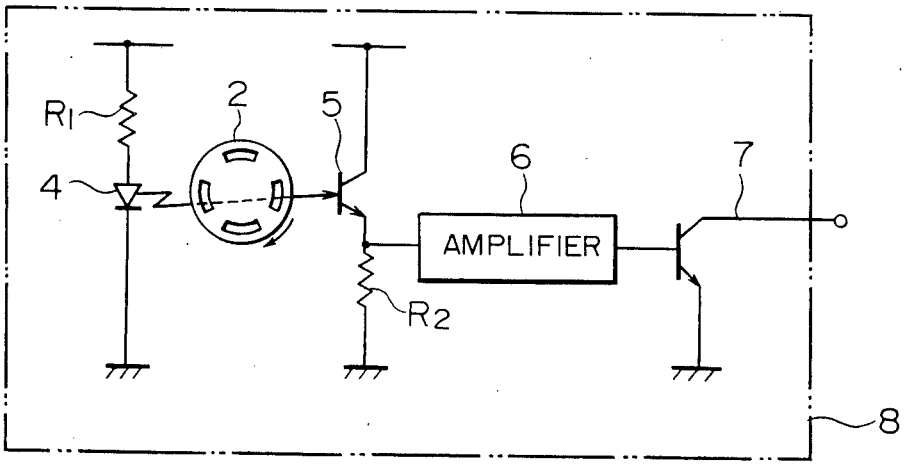
FIG. 2 is a circuit diagram of the position sensor of FIG. 1.

The rotational position sensor, which includes the elements illustrated in FIG. 1, is shown schematically in FIG. 2 and is indicated by reference numeral 8. When the light which is generated by the light emitting diode 4 passes through one of the slits 3*a* or 3*b* of the disk 2 and strikes the phototransistor 5, the phototransistor 5 conducts and current flows through the phototransistor 5 and a resistor R2 which is connected to the emitter of the phototransistor 5. An amplifier 6 amplifies the voltage across the resistor R2 and provides the amplified signal to the base of an open-collector output transistor 7.

Figure 3:
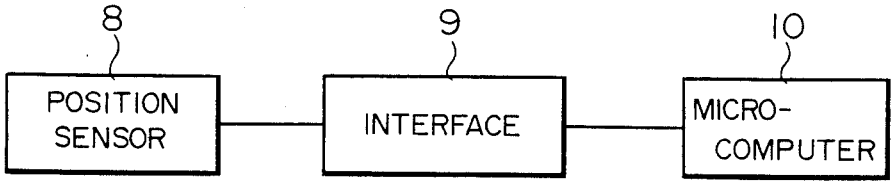
FIG. 3 is a block diagram of the connection between the rotational position sensor and a microcomputer.

As shown in FIG. 3, the output signal of the position sensor 8 is input to a microcomputer 10 via an interface 9. Based on the signal from the position sensor 8, the microcomputer 10 recognizes the reference cylinder and controls the ignition timing, the fuel injection, and other aspects of engine operation.

Figure 4:
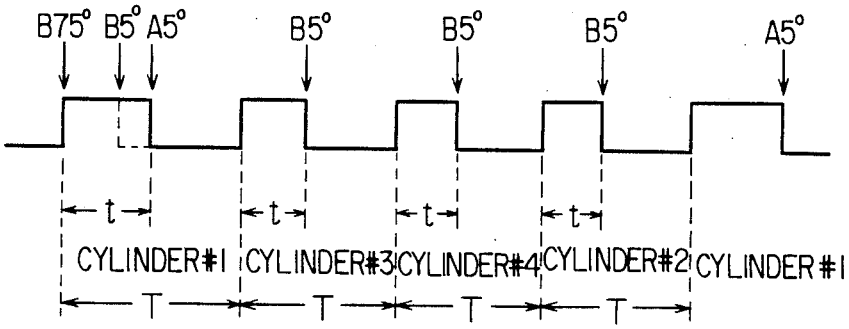
FIG. 4 is a wave form diagram of the output signal of the position sensor.

FIG. 4 illustrates the output signal of the position sensor 8. The output signal is in the form of pulses having a rising edge corresponding to the leading edge L and a falling edge corresponding to the trailing edge T of each slit of the disk 2. In FIG. 4, a rising edge of an output pulse occurs when the piston of the corresponding cylinder is at 75° BTDC. For all but the reference cylinder, the falling edge occurs when the piston of the corresponding cylinder is at 5° BTDC, while for the reference cylinder (cylinder #1), the falling edge occurs when the piston of the reference cylinder is at 5° ATDC. However, the piston positions corresponding to the rising and falling edges in FIG. 4 are just examples, and different values can be employed.

Figure 5:
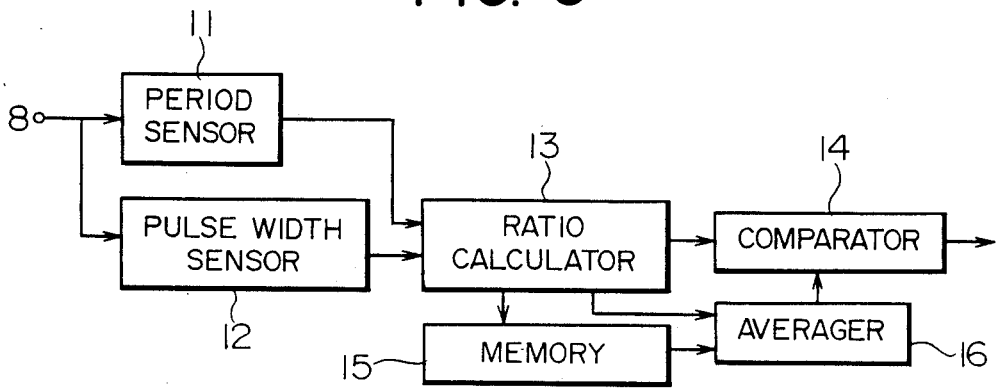
FIG. 5 is a block diagram of a first embodiment of a cylinder recognition circuit.

The microcomputer 10 includes a cylinder recognition circuit for recognizing the reference cylinder based on the output signal of the position sensor 8. FIG. 5 is a block diagram of a first embodiment of the cylinder recognition circuit. As shown in FIG. 5, the output signal from the position sensor 8 is input to a period sensor 11 which measures the period T between consecutive output pulses of the position sensor 8. In this embodiment, the period sensor 11 measures the period between consecutive rising edges of the output signal, but it could instead measure the period between consecutive falling edges. The period sensor 11 generates an output signal indicating the measured period T and provides it to a ratio calculator 13.

The output signal from the position sensor 8 is also input to a pulse width sensor 12 which measures the pulse width t of the output pulses from the position sensor 8. The pulse width sensor 12 generates an output signal indicating the measured pulse width t and provides it to the ratio calculator 13. The ratio calculator 13 calculates the ratio t/T of the pulse width t to the period T and generates a corresponding output signal which is provided to a memory 15, to an averaging circuit 16, and to a comparator 14.

The averaging circuit 16 calculates the average of the ratio t/T for two consecutive output pulses of the position sensor 8 by the formula $\alpha=[(t/T)_{n-1}+(t/T)_n]/2$, wherein $(t/T)_{n-1}$ is the value of the ratio which was calculated for the preceding output pulse of the position sensor 8 and stored in the memory 15, and $(t/T)_n$ is the most recently calculated ratio. After the averaging is performed, the old ratio $(t/T)_{n-1}$ in the memory 15 is replaced by the new ratio $(t/T)_n$. The calculated average $\alpha$ is input to the comparator 14.

The comparator 14 compares the most recently calculated ratio $(t/T)_n$, which is input from the ratio calculator 13, with the average $\alpha$, which is input from the averaging circuit. If the ratio $(t/T)_n$ is larger than the average $\alpha$, the comparator 14 generates an output signal having a first level which indicates that the cylinder corresponding to the most recently measured pulse width t is the reference cylinder. On the other hand, if the ratio $(t/T)_n$ is smaller than or equal to the average $\alpha$, the comparator 14 generates an output signal having a second level which indicates that the pulse width t corresponds to one of the other cylinders.

Figure 6:
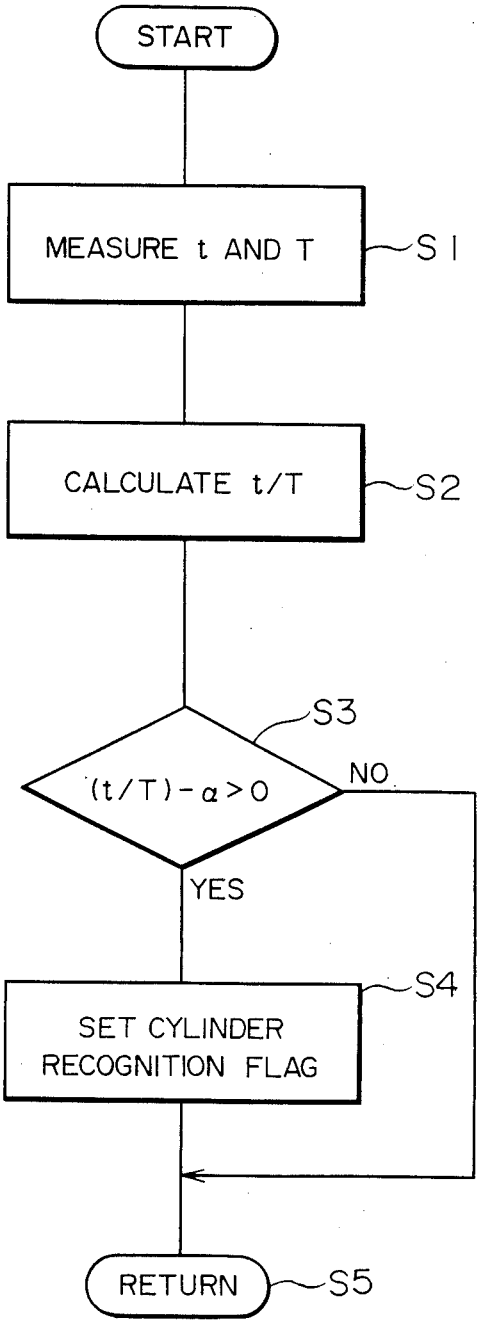
FIG. 6 is a flow chart of a method of circuit recognition performed by the cylinder recognition circuit of FIG. 5.

FIG. 6 is a flow chart illustrating a routine performed by the microcomputer 10 for recognizing the reference cylinder. In Step S1, the period T and the pulse width t of the output signal of the position sensor 8 are measured. In Step S2, the most recent ratio $(t/T)_n$ is calculated. In Step S3, the ratio $(t/T)_n$ is compared with the average $\alpha$. If the ratio $(t/T)_n$ is larger than $\alpha$, then in Step S4, the reference cylinder is recognized, and a flag is set in a register corresponding to the reference cylinder. If the ratio $(t/T)_n$ is not larger than the average $\alpha$, then a return is performed in Step S5.

The cylinders fire in a prescribed order (#1-#3-#4-#2, for example), so by counting the number of output pulses of the position sensor 8 since the output pulse corresponding to the reference cylinder, the microcomputer 10 can identify each of the cylinders and individually control them.

The engine ignition timing is also calculated by the microcomputer 10 based on various input signals from unillustrated sensors. The microcomputer 10 controls an unillustrated igniter to ignite the spark plugs for each of the cylinders. Normally, the microcomputer 10 controls the igniter so that ignition takes place in each cylinder a certain number of degrees of crankshaft rotation after the rising edge of the corresponding pulse in FIG. 4. When the engine is cranking, however, ignition takes place upon the falling edge of each pulse. Therefore, during cranking, the reference cylinder is ignited 10 degrees later with respect to top dead center than are the other cylinders. However, this relative delay in the firing of the reference cylinder is not harmful and avoids ignition taking place too early.

The structure and operation of a microcomputer for controlling the timing of ignition and fuel injection are well known to those skilled in the art, and as those portions of the microcomputer 10 which performs these functions are not part of the present invention, a detailed description thereof will be omitted.

As a cylinder recognition apparatus according to the present invention recognizes a reference cylinder on the basis of the ratio t/T, the accuracy of cylinder recognition is not dependent on the absolute values of t or T, so accurate cylinder recognition can be performed when the engine rotational speed is in transition. Comparison of ratios also has the advantage that it negates the effect of sensor error, which commonly occurs in electronic sensing circuits, in which the entire output deviates in one direction.

Furthermore, as a cylinder recognition apparatus according to the present invention requires only one rotational position sensor 8, it is compact and can be inexpensively manufactured.

In the embodiment of FIG. 5, the ratio calculator 13 calculates the ratio t/T of the pulse width t to the period T. However, the ratio calculator 13 could instead calculate the ratio t/(T−t) of the pulse width t to the interval (T−t) between consecutive pulses, and the comparator 14 could recognize the reference cylinder by comparing this ratio t/(T−t) with a prescribed value.

Figure 7:
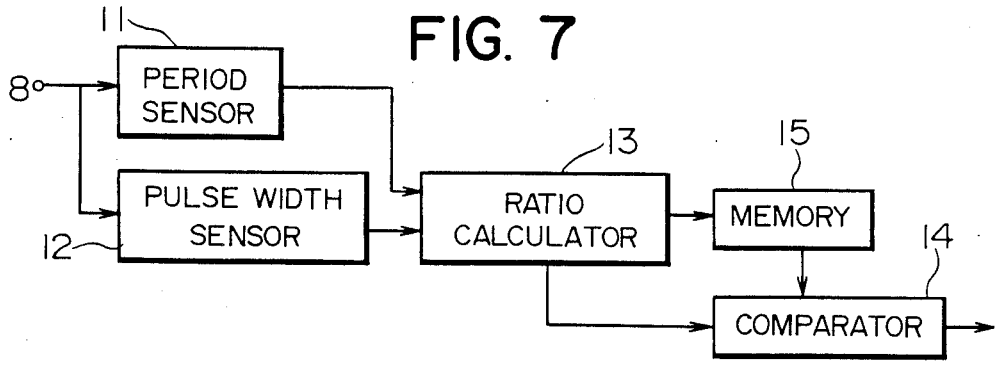
FIG. 7 is a block diagram of a second embodiment of a cylinder recognition circuit.

FIG. 7 is a block diagram of a second embodiment of a cylinder recognition circuit according to the present invention. Like the embodiment of FIG. 5, this embodiment has a period sensor 11 and a pulse width sensor 12 which respectively measure the period T and the pulse width t of the output signal from the position sensor 8. The output signals of sensors 11 and 12 are input to a ratio calculator 13, which calculates the ratio t/T or t/(T−t). A signal indicating the ratio is input to a comparator 14 and a memory 15. The memory 15 temporarily stores the output of the ratio calculator 13 and provides it to the comparator 14. The comparator 14 compares the most recently calculated ratio $[t/T]_n$ or $[t/(T-t)]_n$ from the ratio calculator 13 with the ratio $[t/T]_{n-1}$ or $[t/(T-t)]_{n-1}$ for the previous output pulse of the position sensor 8, which was stored in the memory 15. The structure of this embodiment is otherwise the same as that of the previous embodiment.

Figure 8:
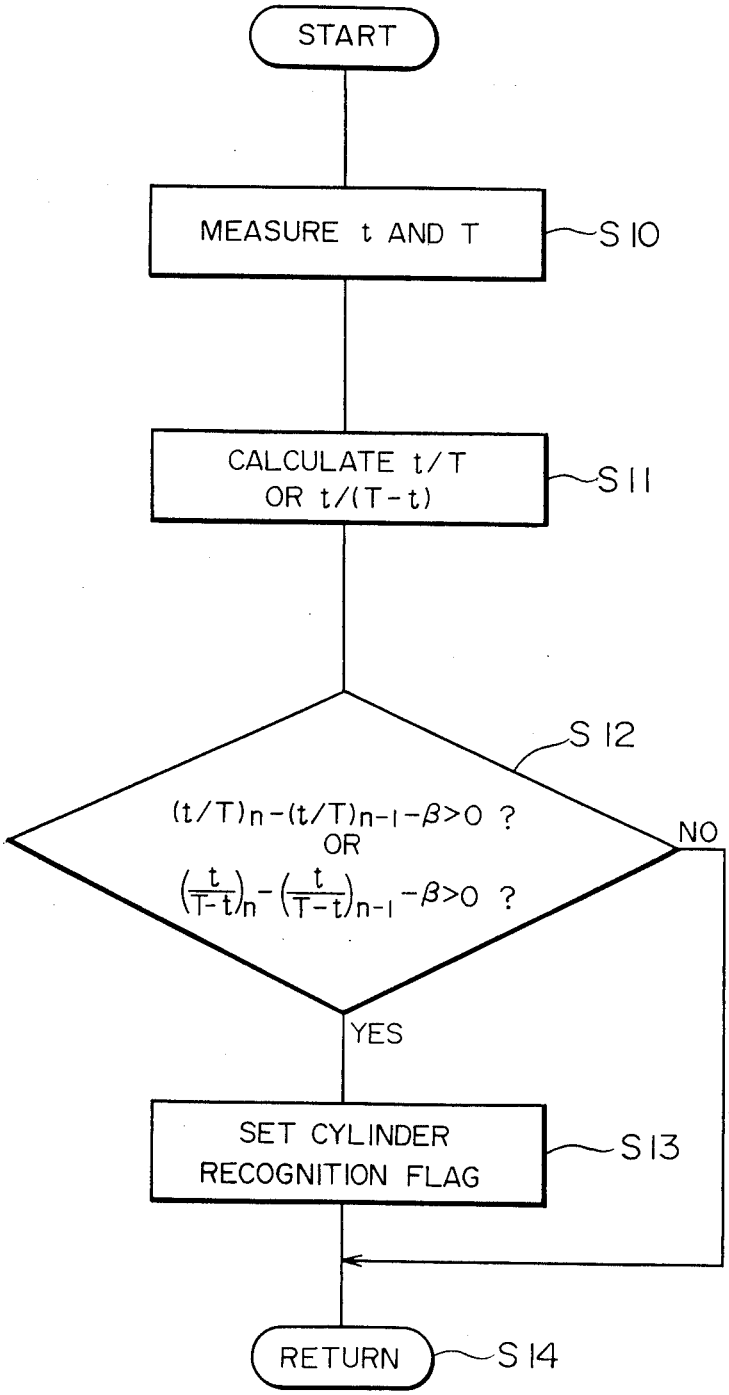
FIG. 8 is a flow chart of a method of circuit recognition performed by the cylinder recognition circuit of FIG. 7.

FIG. 8 is a flow chart of the operation of the cylinder recognition circuit of FIG. 7. In Step S10, the period sensor 11 and the pulse width sensor 12 measure the period T and the pulse width t, respectively, of the output signal of the position sensor 8. The period T and the pulse width t are provided to the ratio calculator 13, which in Step S11 calculates the ratio $[t/T]_n$ or $[t/(T-t)]_n$. The calculated ratio is input to the comparator 14 and to the memory 15, which stores the ratio. In Step S12, the comparator 14 compares the most recently calculated ratio $[t/T]_n$ or $[t/(T-t)]_n$ from the ratio calculator 13 with a ratio $[t/T]_{n-1}$ or $[t/(T-t)]_{n-1}$ for the immediately preceding output pulse which was stored in the memory 15. In Step S12, the comparator 14 determines if the difference between the most recently calculated ratio and the ratio for the preceding output pulse which was read from the memory 15 is larger than a prescribed value $\beta$. If the difference is larger than $\beta$, then in Step S13, the comparator 14 generates an output signal having a first level to indicate recognition of the reference cylinder, and a flag is set in a register corresponding to the reference cylinder. If the difference is not larger than $\beta$, then the comparator 14 generates an output signal having a second level to indicate a cylinder other than the reference cylinder, and in Step S14 a return is performed.

On the basis of the output signal of the comparator 14, the microcomputer 10 can control the individual cylinders of the engine, as was described with respect to the preceding embodiment. As this embodiment recognizes the reference cylinder by the comparison of ratios, it provides the same benefits as that embodiment.

Figure 9:
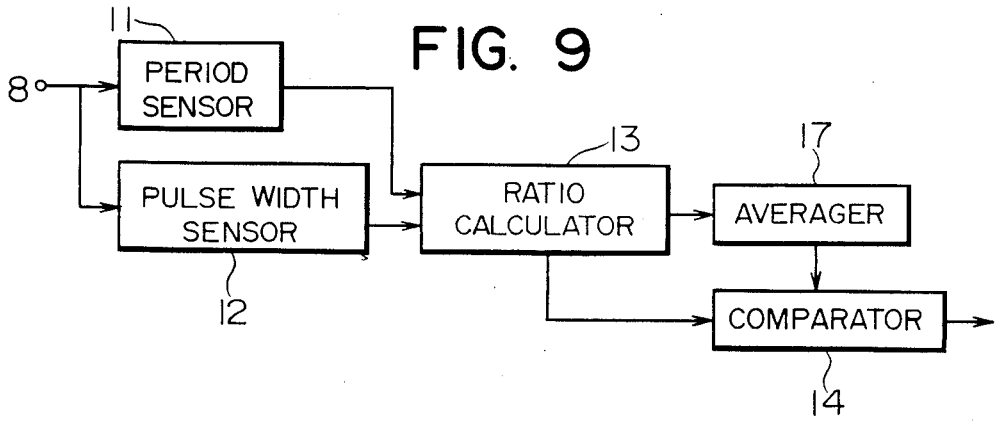
FIG. 9 is a block diagram of a third embodiment of a cylinder recognition circuit.

FIG. 9 illustrates a third embodiment of a cylinder recognition circuit. This circuit is similar to the circuit of FIG. 7, except the memory 15 has been replaced by an averaging circuit 17. The averaging circuit 17 calculates a running average $\alpha_n$ of the output of the ratio calculator 13 and provides a corresponding output signal to the comparator 14. The ratio calculator 13 calculates the ratio t/T or t/(T−t). The comparator 14 compares the ratio which is calculated by the ratio calculator 13 with the average $\alpha_n$ which is calculated by the averaging circuit 17. When the ratio is larger than the average $\alpha_n$, the comparator 14 generates an output signal having a first level to indicate recognition of the reference cylinder, and when the ratio is smaller than the average $\alpha_n$, the comparator 14 generates an output signal having a second level to indicate one of the other cylinders. The output signal of the comparator 14 is used by the microcomputer 10 to control the cylinders, as in the preceding embodiments.

The averaging circuit 17 can be a circuit which calculates the actual arithmetic mean of the ratios t/T or t/(T−t) for four consecutive output pulses of the position sensor 8, up to and including the most recent pulse. However, it is also possible to employ a simpler circuit which calculates a simulated average by the formula $$\alpha_n=(1-k)\cdot\alpha_{n-1}+k\cdot(t/T)_n \text{ or}$$

$$\alpha_n=(1-k)\cdot\alpha_{n-1}+k\cdot[t/(T-t)_n$$

wherein k is a constant, the subscript n indicates the most recently calculated value, and the subscript (n−1) indicates a value which was calculated for the preceding output pulse.

Each time the averaging circuit 17 calculates the most recent average $\alpha_n$, in addition to the average $\alpha_n$ being provided to the comparator 14, it is stored in an internal memory of the averaging circuit 17 and becomes the previous average $\alpha n-1$ when calculating $\alpha_n$ at the time of the subsequent output pulse of the position sensor 8.

When calculating the average ratio $\alpha_n$, the terms $(1-k)\cdot\alpha n-1$ and $k\cdot(t/T)_n$ or $k\cdot[t/(T-t)_n$ are rounded towards the ratio t/T or t/(T−t) for the reference cylinder. Namely, if the ratio for the reference cylinder is larger than the average ratio $\alpha_n$, then these terms are rounded up, and if the ratio for the reference cylinder is smaller than the average ratio $\alpha_n$, these terms are rounded down. In the present embodiment, the ratio for the reference cylinder is larger than the average ratio $\alpha_n$, so these terms are rounded up. The average ratio $\alpha_n$ is closer in magnitude to the ratio for the other cylinders than it is to the ratio for the reference cylinder, so rounding the average ratio $\alpha_n$ towards the ratio for the reference cylinder provides a margin which increases the accuracy of comparison by the comparator 14 when it is comparing the average ratio $\alpha_n$ with the ratio of one of the other cylinders.

For example, if $k=\frac{1}{4}$, $\alpha_{n-1}=99$, and $(t/T)_n=110$, then the exact value of $\alpha_n$ is $74.25+27.5=101.75$. If each term is rounded up, then $\alpha_n$ becomes $75+28=103$.

Figure 10:
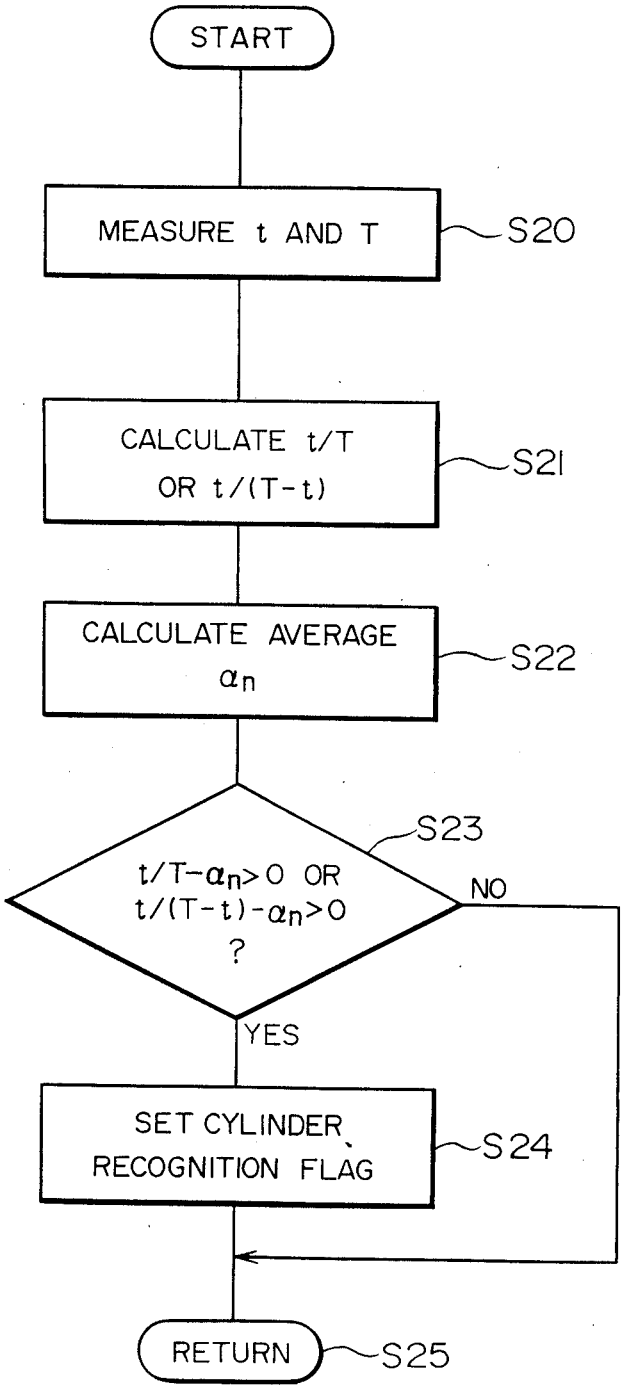
FIG. 10 is a flow chart of a method of circuit recognition performed by the cylinder recognition circuit of FIG. 9.

FIG. 10 is a flow chart of the operation of the cylinder recognition circuit of FIG. 9. In Step S20, the period sensor 11 and the pulse width sensor 12 measure the period T and the pulse width t, respectively, of the output signal of the position sensor 8. The period T and the pulse width t are provided to the ratio calculator 13, which in Step S21 calculates the ratio t/T or t/(T−t). The calculated ratio is input to the comparator 14 and to the averaging circuit 17, which in Step S22 calculates the average ratio $\alpha_n$ as described above. In Step S23, the comparator 14 compares the average ratio $\alpha_n$ with the most recently calculated ratio from the ratio calculator 13. If the ratio t/T or t/(T−t) is larger than the average ratio $\alpha_n$, then in Step S24, the comparator 14 generates an output signal having a first level to indicate recognition of the reference cylinder, and a flag is set in a register corresponding to the reference cylinder. If the ratio is not larger than the average ratio $\alpha_n$, then the comparator 14 generates an output signal having a second level to indicate a cylinder other than the reference cylinder, and in Step S25 a return is performed. On the basis of the output signal of the comparator 14, the microcomputer 10 can control the individual cylinders of the engine, as was described with respect to the preceding embodiments.

In the illustrated embodiments, the position sensor 8 generates a high output signal when it detects the leading edge L and a low output signal when it detects the trailing edge T of a slit 3*a* or 3*b*. However, it is possible to switch the polarity of the output signal and still obtain the same benefits.

What is claimed is:

1. A cylinder recognition apparatus for a multi-cylinder internal combustion engine comprising:

a position sensor for generating a series of signals, each signal corresponding to one of the cylinders of the engine and indicating a first position and a second position with respect to top dead center of a piston of the corresponding cylinder, the number of degrees of crankshaft rotation between the first and second positions being different for a prescribed reference cylinder of the engine than for the other cylinders of the engine;

first period measuring means responsive to the position sensor for measuring a first period T between consecutive occurrences of one of the positions;

second period measuring means responsive to the position sensor for measuring a second period t between consecutive first and second positions;

ratio calculating means for calculating a series of ratios, each ratio corresponding to one of the cylinders of the engine and being a function of t and T for the corresponding cylinder; and a comparator for comparing each ratio in succession with a prescribed value and generating an output signal indicating the result of the comparison.

2. A cylinder recognition apparatus as claimed in claim 1, wherein the ratio is t/T.

3. A cylinder recognition apparatus as claimed in claim 1, wherein the ratio is t/(T−t).

4. A cylinder recognition apparatus as claimed in claim 1, wherein the prescribed value is the ratio corresponding to the preceding cylinder in the firing order of the engine.

5. A cylinder recognition apparatus as claimed in claim 1, wherein the prescribed value is the average of the ratios corresponding to two consecutive cylinders in the firing order of the engine.

6. A cylinder recognition apparatus as claimed in claim 1, wherein the prescribed value is the average of the ratios corresponding to all the cylinders in a single cycle of the engine.

7. A cylinder recognition apparatus as claimed in claim 6, wherein the prescribed value corresponding to a cylinder is expressed by the formula $$\alpha_n=(1-k)\cdot\alpha_{n-1}+k\cdot R$$

wherein k is a constant, $\alpha_{n-1}$ is the prescribed value corresponding to the previous cylinder in the firing order of the engine, and R is the ratio which is being compared with the prescribed value.

8. A cylinder recognition apparatus as claimed in claim 6, wherein the average is rounded towards the ratio corresponding to the reference cylinder.

9. A cylinder recognition apparatus as claimed in claim 1, wherein the first position is the same for all the cylinders of the engine.

10. A cylinder recognition apparatus as claimed in claim 9, wherein the second position is later for the reference cylinder than for the other cylinders.

11. A cylinder recognition apparatus as claimed in claim 1, wherein the position sensor comprises:

a rotating shaft which is rotated in synchrony with the engine;

a rotating disk which is secured to the rotating shaft and which has a plurality of slits formed therein at a uniform distance from the center of the disk and which extend in the circumferential direction of the disk, the number of slits equaling the number of cylinders of the engine, all of the slits except a reference slit having the same length in the circumferential direction of the disk;

a light source disposed on one side of the disk; and a light sensor disposed on the other side of the disk for sensing the passage of light from the light source through the slits.

12. A cylinder recognition apparatus for an internal combustion engine comprising:

a position sensor for generating a series of pulses, each pulse corresponding to one of the cylinders of the engine and having a rising edge indicating a first position and falling edge indicating a second position with respect to top dead center of a piston of the corresponding cylinder, the number of degrees of crankshaft rotation between the rising and falling edges being different for a pulse corresponding to a prescribed reference cylinder of the engine than for pulses corresponding to the other cylinders of the engine;

first period measuring means for measuring the period T between the pulses;

second period measuring means for measuring the pulse width t of the pulses;

ratio calculating means for calculating for each cylinder a ratio which is a function of the period T and the pulse width t; and a comparator for comparing each ratio in succession with a prescribed value and generating an output signal indicating the result of the comparison.

13. A method for recognizing a prescribed reference cylinder of a multi-cylinder internal combustion engine comprising:

generating for each cylinder a signal indicating a first and a second position of a piston of the cylinder with respect to top dead center, the number of degrees of crankshaft rotation between the first and second positions being different for a reference cylinder than for the other cylinders of the engine;

measuring a first period T between consecutive occurrences of one of the positions;

measuring a second period t between consecutive first and second positions;

calculating a ratio which is a function of the first and second periods T and t;

comparing the ratio with a prescribed value; and recognizing the reference cylinder on the basis of the comparison.

14. A method as claimed in claim 13, wherein the ratio is t/T.

15. A method as claimed in claim 13, wherein the ratio is t/(T−t).

16. A method as claimed in claim 13, wherein the prescribed value is the ratio corresponding to the preceding cylinder in the firing order of the engine.

17. A method as claimed in claim 13, wherein the prescribed value is the average of the ratios corresponding to two consecutive cylinders in the firing order of the engine.

18. A method as claimed in claim 13, wherein the prescribed value is the average of the ratios corresponding to all of the cylinders in a single cycle of the engine.

19. A method as claimed in claim 18, wherein the prescribed value corresponding to a cylinder is expressed by the formula $$\alpha_n=(1-k)\cdot\alpha_{n-1}+k\cdot R$$

wherein k is a constant, $\alpha_{n-1}$ is the prescribed value corresponding to the previous cylinder in the firing order of the engine, and R is the ratio which is being compared with the prescribed value.

20. A method as claimed in claim 18, wherein the average is rounded towards the ratio corresponding to the reference cylinder.

* * * * *